US007495539B2

(12) United States Patent
Sundaram

(10) Patent No.: US 7,495,539 B2
(45) Date of Patent: Feb. 24, 2009

(54) FILAMENT TRANSFORMER FOR X-RAY TUBES

(75) Inventor: Senthil Kumar Sundaram, Sanpada (IN)

(73) Assignee: General Electric Company, Schenectady, NY (US)

( * ) Notice: Subject to any disclaimer, the term of this patent is extended or adjusted under 35 U.S.C. 154(b) by 95 days.

(21) Appl. No.: 11/537,818

(22) Filed: Oct. 2, 2006

(65) Prior Publication Data

US 2008/0079525 A1 Apr. 3, 2008

(51) Int. Cl.
*H01F 27/28* (2006.01)

(52) U.S. Cl. ..... 336/208; 336/198; 336/192

(58) Field of Classification Search ..... 336/198, 336/208, 212, 192
See application file for complete search history.

(56) References Cited

U.S. PATENT DOCUMENTS 4,977,301 A * 12/1990 Maehara et al. ..... 219/715
5,695,477 A 12/1997 Sfikas
6,518,870 B2 2/2003 Yeh et al.
2002/0145497 A1 10/2002 Yeh et al.
2003/0030534 A1 * 2/2003 Gu et al. ..... 336/221
2005/0219029 A1 * 10/2005 Watanabe et al. ..... 336/208
2006/0202789 A1 * 9/2006 Hyvonen ..... 336/200

* cited by examiner

*Primary Examiner*—Anh T Mai

(57) ABSTRACT

The present invention provides an in-line filament transformer for a vacuum device. The filament transformer comprises: a core; a primary winding and a secondary winding wound around the core, wherein the secondary winding is biased at a high voltage and the primary winding is placed in line with the secondary winding; and a shield for shielding the primary winding. In an embodiment, the transformer comprises a bobbin for incorporating primary winding and secondary winding. An arrangement of increasing creepage distance is incorporated in the bobbin by providing plurality of sections on the bobbin. The invention also provides a shield in the primary section of the bobbin for shielding the primary winding from the secondary winding. In an embodiment the shield is in the form of shield winding of thin wires wound in a defined manner.

16 Claims, 4 Drawing Sheets

FILAMENT TRANSFORMER FOR X-RAY TUBES

FIELD OF THE INVENTION

This invention generally relates to a transformer for a bipolar vacuum tube and more particularly to a filament transformer for an X-ray tube.

BACKGROUND OF THE INVENTION

In an X-ray machine, the X-ray tube is often a bipolar tube having an anode and a cathode maintained at a high voltage potential. The tube has a filament, a low resistance element, maintained close to the cathode potential and having a controllable current on the order of a few Ampere passing through it to sustain thermionic emission to drive the commanded X-ray tube current. This current is supplied by a filament transformer and the low resistance nature of the filament causes the required high current with application of a voltage on the order of Volts. Therefore, often a 1:1 or a step down design of transformer is used for this application, having primary number of turns equal or higher than the secondary number of turns. The secondary winding is biased to the cathode potential to have the voltage generated by the filament transformer to operate at high voltage potential, a design constrain resulting from the X-ray tube.

Two parameters for measuring the performance of any insulation including transformer insulation are creepage distance and clearance. These are measured between any two metallic points (for example, winding and the core) in the transformer and in relation to the surrounding (for example, chassis) in which the transformer is used.

A high voltage transformer for its intended functioning requires adequate electrical isolation between its windings and with respect to its core. These isolation requirements are achieved by the use of insulated wire on the insulating bobbins that hold the windings on the core. Additional insulation may be provided by the use of insulating papers and polymer tapes between winding layers.

A high voltage transformer is more typically made with a primary winding and a secondary winding concentric with the primary winding, with the primary winding placed close to the core and the secondary winding placed over the primary winding. This arrangement allows adequate insulation between the primary winding and the secondary winding with the use of an appropriate thickness of bobbin. The requirement of a grounded shield for safety purposes is handled with placement of the shield between primary and secondary winding, often directly on the primary winding.

The concentric design of the typical transformer windings discussed above requires substantial window space in the selection of the core. This need for substantial window space is because the window space has to accommodate the primary winding along with its bobbin section and then the secondary winding along with its bobbin section and further to accommodate enough insulation material between the windings and between the secondary winding and the core (the other arm of the core).

For this reason, when it comes to the use of high-voltage transformers specially adapted for use in low power X-ray machines, which typically require light weight and compact packaging, the concentric design of the filament transformer becomes one of the bulky and voluminous option for the X-ray machine. Thus there exists a need to design a filament transformer suitable for bipolar X-ray tubes.

SUMMARY OF THE INVENTION

The above-mentioned shortcomings, disadvantages and problems are addressed herein which will be understood by reading and understanding the following specification.

The present invention provides a filament transformer for an X-ray tube. The filament transformer comprises: (a) a core; (b) a primary winding and a secondary winding wound around the core, wherein the secondary winding is biased at a high voltage and the primary winding is placed in line with the secondary winding; and (c) a shield for the primary winding. In an embodiment, the transformer further includes a bobbin for incorporating the primary winding and the secondary winding. An arrangement for increasing creepage distance is incorporated in the bobbin by providing a plurality of partitions on the bobbin. In addition to the modifying the creepage distance, these partitions provide the required clearance between the primary winding and the secondary winding in the form of a solid barrier along with the insulation medium around (which may be, for example, oil).

In another embodiment, a filament transformer for an X-ray tube is provided. The filament transformer comprises; (a) a core; (b) a primary winding and a secondary winding wound around the core, wherein the secondary winding is biased at a high voltage and the primary winding is placed in line with the secondary winding; and (c) a bobbin having a primary section incorporating the primary winding and a secondary section incorporating the secondary winding and at least one partition configured to be empty. In an embodiment, the partitions of the bobbin include a first partition provided on the secondary section of the bobbin adjacent to the primary section of the bobbin and a second partition provided on the secondary section of the bobbin adjacent to the core.

In yet another embodiment, a method of shielding in an in-line filament transformer having a primary winding and a secondary winding wound in a line around a bobbin is provided. The method includes: providing a shield in a primary section of the bobbin for shielding direct fields and fringe fields between the primary winding and the secondary winding. In an embodiment, the shield is in the form of a winding that is wound around the primary winding in a defined manner.

The method of winding the shield in the defined manner may include, in one embodiment, the steps of (a) defining a gap in the primary section of the bobbin, the gap is defined in the primary section of the bobbin adjacent to the secondary section of the bobbin; (b) winding a layer of the shield across the primary section of bobbin along the bobbin axis, up to the gap; (c) winding primary winding inside the primary section of the bobbin up to the gap; (d) winding additional layers of shield in the gap; and (e) winding a layer of a shield over the primary winding.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part thereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

In various embodiments, a filament transformer for a bipolar X-ray tube including a secondary winding biased at a high voltage and a primary winding placed in line with the secondary winding on a magnetic core is provided. In an embodiment, the invention provides an arrangement for increasing creepage distance in compact transformers. More particularly, embodiments of the invention provide a technique for increasing the creepage distance between the primary winding and the secondary winding in a transformer, which may have a compact design. Yet another embodiment of the invention provides a shielding technique in an in-line transformer for shielding the primary winding from the secondary winding. The term windings referred to in the description refers to a primary winding and a secondary winding and the term in-line transformer indicates a transformer with both a primary winding and a secondary winding placed on the same arm of a core.

Various embodiments of the present invention provide an in-line filament transformer for a bipolar X-ray tube and an arrangement for increasing creepage and insulation and shielding methods for an X-ray tube having a filament transformer at high voltage. The embodiments, however, are not so limited, and may be implemented in connection with other systems, such as transformers capable of use in high voltage lighting applications, vacuum tube amplifiers, X-ray generators and so forth, to mention a few. Further the technique of increasing the creepage distance and providing shielding between the primary winding and the secondary winding described herein may be used in any high voltage transformer.

Figure 1A:
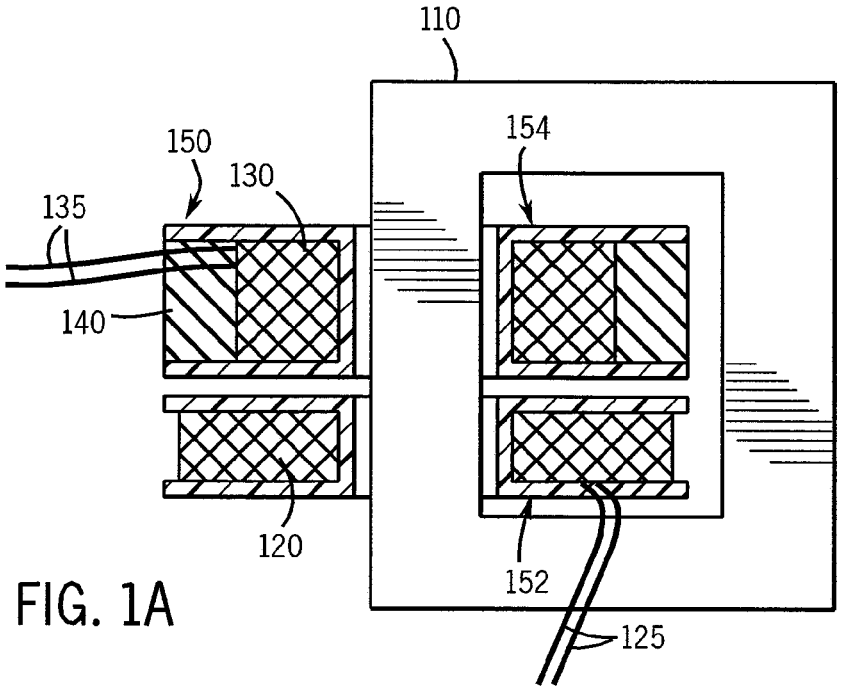
FIG. 1A is a front view of a transformer, with a primary winding and a secondary winding placed in a line as described in an embodiment of the invention.

FIG. 1A is a front view of a transformer, with primary winding and secondary winding placed in a line as described in an embodiment of the invention. The filament transformer is provided with its secondary winding biased at high voltage and primary winding placed in line with the secondary winding on a magnetic core. The term in-line transformer refers to the transformers in which the primary winding and secondary winding of the transformer are placed on same arm of the core. The filament transformer has the secondary winding biased at a high voltage potential. For example in X-ray generators, the secondary winding are biased at the potential of cathode. The primary winding and the secondary winding are wound around a bobbin axis and the windings are arranged such that they are wound in the same direction. The direction of the bobbin axis is towards the secondary winding. A transformer shown in FIG. 1A comprises a core 110, primary winding 120 and secondary winding 130 and a shield (not shown). The shield is provided for safety and shielding the primary winding from the secondary winding. The core may be made of any magnetic material and may be of any shape. In an example the core comprises a plurality of arms, combined to form a rectangular shape, thereby having a window frame inside the core. An embodiment of the invention provides a transformer with the primary winding and the secondary winding placed in a line. Both the primary winding and the secondary winding are placed on the same arm of the core with help of a single bobbin. The primary winding and the secondary winding are wound around the core. The primary winding is at a low voltage and the secondary winding is at a high voltage. An insulation 340 is provided on the secondary winding 130 to insulate low voltage section, primary windings from the high voltage section, secondary windings.

The transformer further comprises a bobbin 150 on which the primary winding 120 and the secondary winding 130 are wound. The bobbin 150 is placed around the core 110. The bobbin 150 has a primary section 152 and a secondary section 154. The primary section 152 is provided for incorporating the primary winding 120 and the secondary section 154 is provided for incorporating the secondary winding 130. The leads of the primary winding 125 and secondary winding 135 are taken out for providing input and output connections of the transformer. In an example the windings are made out of enameled copper wire. The bobbin 150 is made of an insulating material. In an example bobbin 150 is made of Polyproplyene.

Figure 1B:
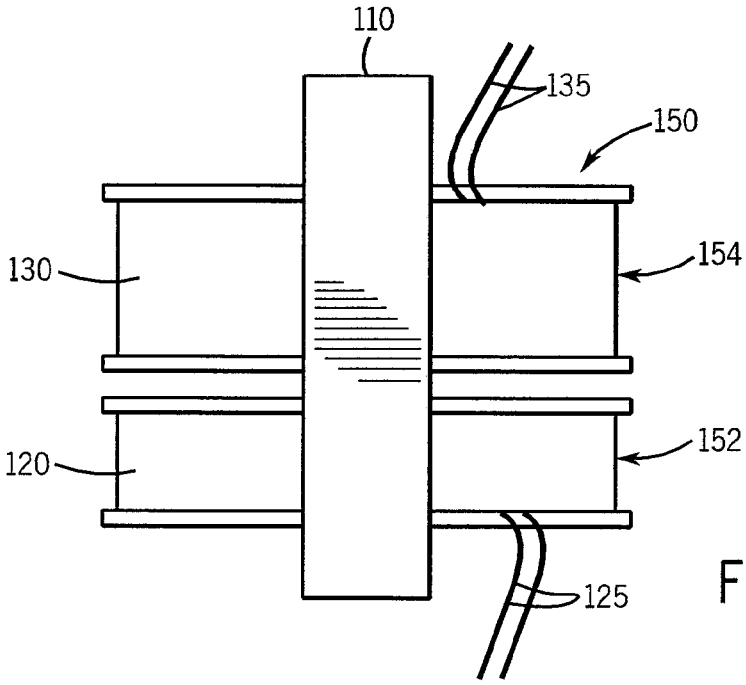
FIG. 1B is a side view of the transformer illustrated in FIG. 1A.

The FIG. 1B is a side view of the filament transformer illustrated in FIG. 1A. As seen the primary winding 120 and secondary winding 130 are wound around the magnetic core 110. A bobbin 150 is provided to incorporate the primary windings and the secondary windings. The bobbin has a primary section 152 and a secondary section 154 for incorporating the primary winding and secondary winding. The in-line transformers are more desirable in case of X-ray tubes with compact design.

Figure 2A:
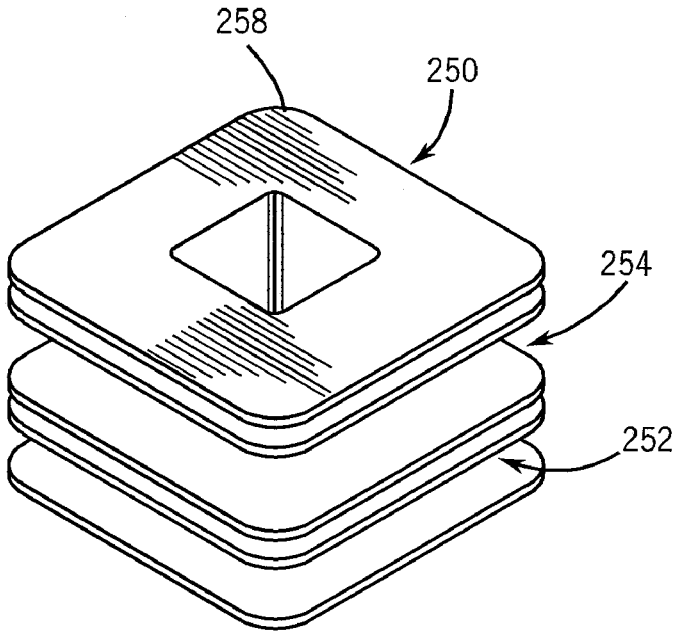
FIG. 2A is a perspective view of a filament transformer bobbin as described in an embodiment of the invention.

The creepage distance between the primary winding 120 and the secondary winding 130 may be not be sufficient to satisfy the safety standards, when the primary winding 120 and the secondary winding 130 are placed in a line. In an embodiment, an arrangement for increasing the creepage distance between the primary winding 120 and the secondary winding 130 is disclosed. FIG. 2A is a perspective view of a filament transformer bobbin as described in an embodiment of the invention. The creepage distance between the primary winding and the secondary winding and the creepage distance between the core and the secondary winding are increased by providing a plurality of partitions on the bobbin.

Figure 2B:
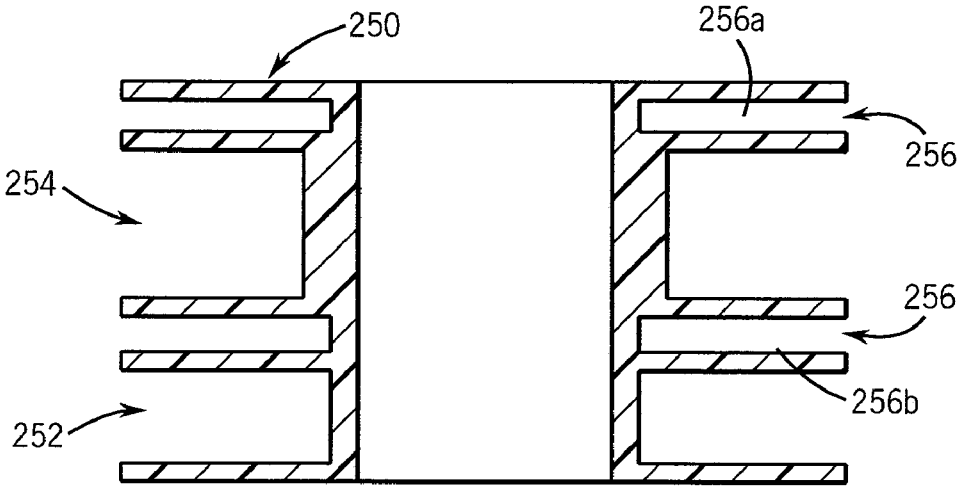
FIG. 2B is a cross sectional view of the bobbin shown in FIG. 2A.

The bobbin 250 is provided around a core 210 with a primary section 252 and a secondary section 254 for incorporating primary winding and secondary winding (not shown). FIG. 2B is the cross sectional view of a filament transformer bobbin shown in FIG. 2A. In an embodiment the secondary section 254 of the bobbin 250 is provided with at least one partition 256 for increasing the creepage distance. The partitions may be kept as empty. The partitions 256 in the secondary section of bobbin include a first partition 256A provided on the secondary section 254 of the bobbin adjacent to the primary section 252 of the bobbin 250. This partition 256A will increase the creepage distance between the primary winding and the secondary winding (not shown) incorporated respectively in the primary section 252 and secondary section 254 of the bobbin 250. A second partition 256B provided on the secondary section 254 of the bobbin adjacent to the core 210. This additional partition on the secondary section 254 of the bobbin near to the core will increase the creepage distance between the secondary winding and the core 210. This also will act as a source of insulation between the core 210 and the secondary winding.

In an embodiment the bobbin 250 is of varying thickness. The thickness at the core side 258 is less. The thickness of the bobbin at the secondary section of the bobbin is more. The difference in thickness of the bobbin corresponds to insulation requirement for primary winding and secondary winding between the winding and the core.

In an embodiment, the first partition 256A, provided on the secondary section 254 of the bobbin, adjacent to the primary section 252 of the bobbin is inserted with a single sheet of an insulating material in the shape of fork. The number of prongs of fork and its thickness and length may be designed by the creepage requirement for the all sides of the bobbin, other than the core side of the bobbin.

Figure 3:
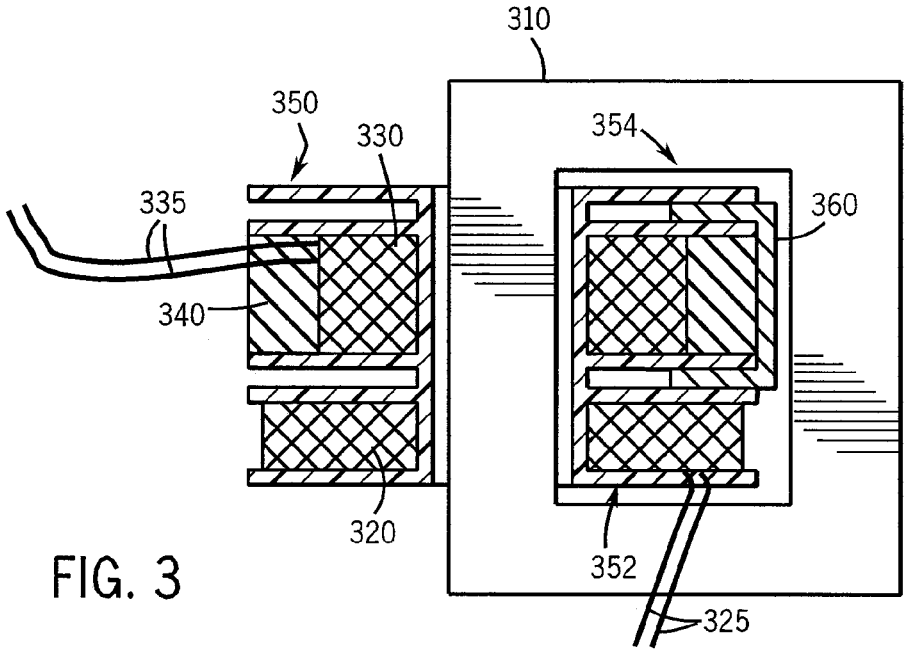
FIG. 3 is a front view of a filament transformer using an insulation as described in an embodiment of the invention.

FIG. 3 is a cross sectional view of a filament transformer using an insulation as described in an embodiment of the invention. The transformer comprises a core 310, primary winding 320 and secondary winding 330 and an insulation 340 provided on the secondary winding 330. The bobbin 350 comprises a primary section 352 and a secondary section 354 for incorporating the primary winding 320 and the secondary winding 330. Since the thickness of the core side is less, there exist an insulation need between the secondary winding and the core. An insulation means is provided between the secondary winding and the core for increasing the insulation between the core and the secondary winding. In an embodiment the insulation means includes inserting an insulating sheet 360 between the secondary windings and the core. In an example the insulating sheet 360 may be bend in the form of "C" or a cap and may be made of Polypropylene. The cap is an insulating material selected from any insulating polymeric material. This sheet acts as an insulation between the core and secondary winding. The leads the primary windings 325 and secondary winding 335 are taken out for providing appropriate input and output connections to the transformer.

Figure 4:
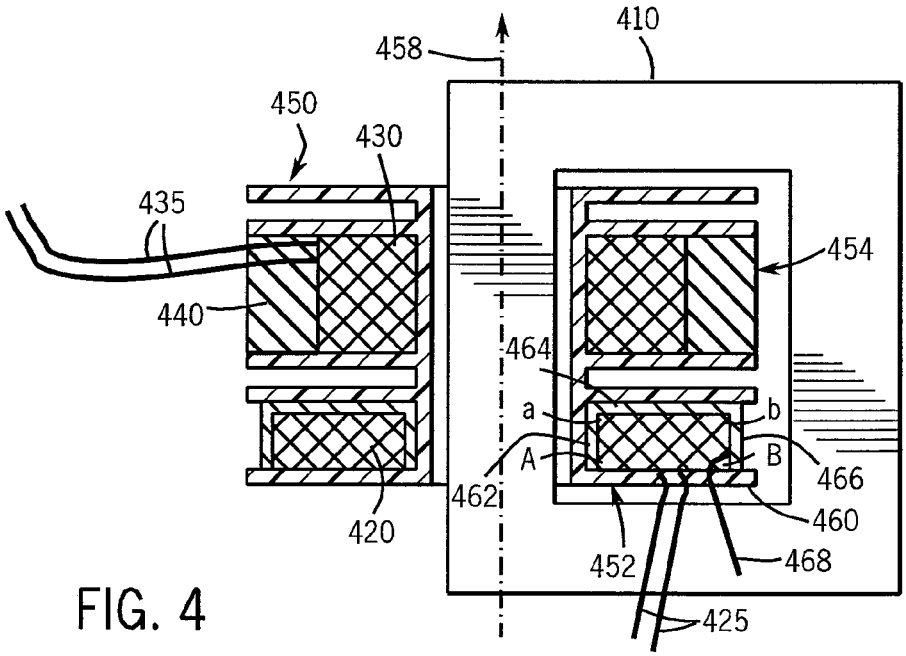
FIG. 4 is a front view of a filament transformer using a shield in the primary section as described in an embodiment of the invention.

FIG. 4 illustrates a cross sectional view of a filament transformer using a shield in the primary section as described in an embodiment of the invention. The shield between and primary winding and secondary winding are required to ensure compliance with EMI/EMC and safety regulations. Technically, the shield breaks the capacitive coupling between the primary winding and the secondary winding and provides protection against surges generated due to arc in high voltage section of the transformer or for any other reason from propagating to low voltage section/mains of the transformer and vise versa. In the constructions that have primary winding and secondary winding in a line, the shield needs to be placed in the same line in between the primary winding and secondary winding. An embodiment of the invention describes a method of providing adequate shielding between primary winding and secondary winding in an in-line transformer.

The filament transformer comprises a core 410, primary winding 420 and secondary winding 430, wound around the core 410. The primary winding 420 and secondary winding 430 are incorporated in a bobbin 450. An insulation 440 is provided on the secondary winding 430 to insulate the primary winding 420 from the secondary winding 430. The bobbin 450 has a primary section 452 and secondary section 454. The primary section 452 incorporates the primary winding 420 and the secondary section 454 incorporates the secondary winding 430. In an embodiment the secondary section 454 of the bobbin is further provided with partitions to increase the creepage distance between the primary winding 420 and the secondary winding 430. The primary winding 420, the secondary winding 430 are wound around a bobbin axis 458. The direction of the bobbin axis 458 is directed towards the secondary winding 430. These windings are wound in the direction of the bobbin axis 458 and the secondary winding are placed above the primary winding. The leads the primary windings 425 and secondary winding 435 are taken out for providing appropriate input and output connections to the transformer.

In an embodiment a shield 460 is provided to incept direct and fringe fields between the windings. Direct field is a uniform electric field between two planes and the fringe field is non-uniform electric field resulting from edges of the windings. Here, the direct field is in the line of the bobbin axis 458 between primary winding and secondary windings. This field terminates in planes perpendicular to the bobbin axis 458. The fringe fields are the one emerging from the edges of the windings and terminating at the plane parallel to the bobbin axis 458.

In an embodiment, to prevent the coupling field as well as fringe field, the shield 460 is provided in the form of windings. The windings are made of thin wires and are provided on the primary section 452 of the bobbin, more accurately between the primary section 452 of the bobbin and the primary winding 420. The thickness of the wire used in shield winding may depend on the available space and the strength of the wire. In an example copper wires having a diameter of 0.1 mm is used for shield winding. The shield 460 is also wound in the direction of the bobbin axis 458.

The shield winding is wound in a defined manner. The method of winding of the shield, in an embodiment includes defining a gap in the primary section 452 of the bobbin towards the secondary section 454 or in the direction of the bobbin axis. This gap is provided to incorporate a part of shield to protect the windings against the direct fields. The width of the gap is designed based on the shielding requirements between the primary winding and secondary winding and also the number of turns and the height of the primary winding. A first layer 462 of the shield is wound across the primary section 452 of bobbin along the axis of the bobbin 458 in the direction of the axis. This winding is performed upto the defined gap. This layer of shield is provided for taking care of the fringe fields. The layer of shield 462 is provided from point "A" to "a' as shown in FIG. 4. Now the winding of the shield are kept on hold and the primary winding 420 are wound along the bobbin axis 458. The winding of the primary winding 420 is done inside the primary section 452 of bobbin till the gap. The method of winding of the primary winding inside the primary section 452 of the bobbin includes winding a first layer of the primary winding 420 in the direction of the bobbin axis 458. Then returning in the direction opposite to the direction of the bobbin axis 458 for winding the next layer of primary winding and winding the next layer of primary winding. Additional layers 464 of the shield 460 are wound on the space provided in the gap. In this space as many layers of winding 464 is made with each layer consisting of one or more turns per layer to match height of primary winding 420 forming the section between top of the primary winding and the primary section 452 of the bobbin. This part of the shield 464 will protect the primary winding 420 from the direct fields. This part 464 is indicated as "a" to "b" in FIG. 4. Finally a layer of a shield 466 is wound over the primary winding 420 and is indicated as "b" to "B". This part of the winding 466 adds mechanical strength to the primary winding as well as it will take care of the fringe fields, which may be affecting the primary winding. The terminal 'A', the starting point of the shield winding, is buried below the primary winding 420 and the terminal 'B', the end point of the shield winding is available as shield terminal 468 for connection.

In an embodiment, the bobbin 450 is provided with a plurality of partitions for increasing the creepage. At least one partition 456 is provided between the primary section 452 of the bobbin and the secondary section 454 of the bobbin. If the size of the partition is deep enough to hold the shield 460, the partition 456 between the primary section and the secondary section may be provided with a shield 460.

In an embodiment, the bobbin 450 may be provided with an additional partition (not shown) between the primary section 452 and the secondary section 454 of the bobbin. The shield 460 may be inserted on this partition. This type of design is possible where, the bobbin have sufficient space to accommodate yet another partition, which can be dedicated for inserting the shield 460.

In an embodiment a spray metalized shield is provided in the primary section or in an exclusive shield section of the bobbin to form shield that either is connected with a wire terminal or grounded with firm mechanical contact with chassis/mounting brackets of the transformer.

In an embodiment, a separate foil based shield is used as a shield for shielding the fringe fields.

Figure 5:
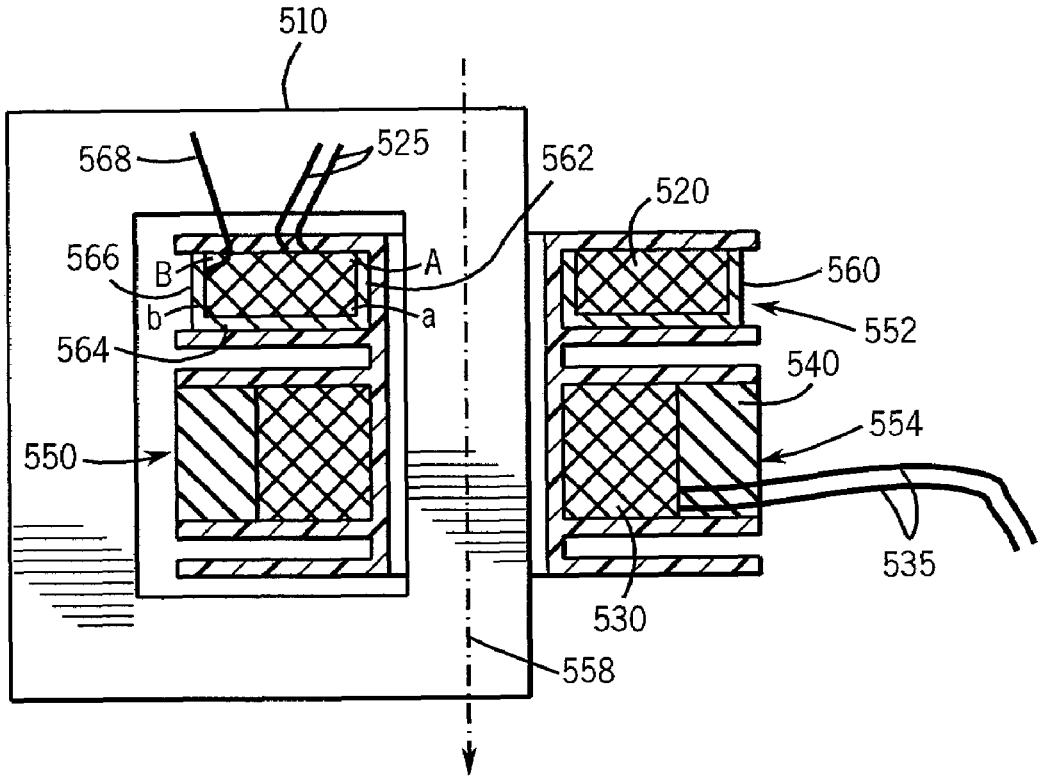
FIG. 5 is a front view of a filament transformer using a shield in the primary section as described in another embodiment of the invention.

FIG. 5 illustrates a cross sectional view of a filament transformer using a shield in the primary section as described in another embodiment of the invention. In an embodiment the primary winding is placed above the secondary winding. In an embodiment the filament transformer 500 comprises a core 510, primary winding 520 and secondary winding 530, wound around the core 510. The primary winding 520 and the secondary winding 530 are incorporated in a bobbin 550. Insulation 540 is provided on the secondary winding 530 to insulate the primary winding 520 from the secondary winding 530. The bobbin 550 has a primary section 552 and secondary section 554. The primary section 552 incorporates the primary winding 520 and the secondary section 554 incorporates the secondary winding 530. The secondary section 554 of the bobbin is further provided with a plurality of partitions to increase the creepage distance between the primary winding 520 and the secondary winding 530. The primary winding 520 and the secondary winding 530 are wound around a bobbin axis 558. The leads the primary windings 525 and secondary winding 535 are taken out for providing appropriate input and output connections to the transformer. The direction of the bobbin axis 558 is directed towards the secondary winding. These windings are wound in the direction of the bobbin axis 558. A shield 560 in the form of shield winding is performed in the same manner as described with reference to FIG. 4. The winding "A" to "a", 562 protects the primary winding 520 from the fringe field and the shield winding "a" to "b", 564 protects the primary winding 520 against the direct field and the shield winding "b" to "B" 566, provide mechanical strength to the primary winding 520. The terminal 'A', the starting point of the shield winding, is buried below the primary winding 520 and the terminal 'B', the end point of the shield winding is available as shield terminal 568 for connection.

The invention provides a compact solution for filament transformer using Polypropylene and oil-paper as main insulation. The invention eliminated the need to go for potting as solution to meet reliability and compactness. This will be advantageous in terms of time and money. The invention provides complete insulation of the primary over the secondary winding as it avoids both the coupling fields and fringe fields. The invention provides an arrangement to increase the creepage distance between the primary winding and secondary winding, with out increasing the size of the bobbin.

Even though the invention has been explained with reference to the filament transformer used in X-ray tubes, the invention need not be limited to this and may be implemented in transformers capable of use in any vacuum devices used in high voltage applications such as lighting applications, vacuum tube amplifiers, X-ray generators and so forth, to mention a few.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

What is claimed is:

1. A filament transformer for an X-ray tube comprising;

(a) a core;

(b) a primary winding and a secondary winding wound around a bobbin placed on the core, wherein the bobbin is configured to include a primary section for incorporating the primary winding and a secondary section for incorporating the secondary winding;

(c) a plurality of partitions provided on the bobbin, wherein a first partition is provided on the secondary section adjacent to the primary section of the bobbin and a second partition is provided on the secondary section of the bobbin adjacent to the core; and (d) an insulation means provided between the secondary winding and the primary winding, wherein the insulation means is in the form of a fork provided on at least one of the partitions on the bobbin.

2. The filament transformer as claimed in claim 1, wherein the bobbin is made of an insulating material.

3. The filament transformer as claimed in claim 1 further comprising, a second insulation means, provided between the secondary winding and the core.

4. The filament transformer as claimed in claim 3, wherein the second insulation means includes a cap provided between the secondary winding and the core, the cap being made of an insulating material.

5. The filament transformer as claimed in claim 1, further comprising a shield in the form of a shield winding, provided in the primary section of the bobbin.

6. The filament transformer as claimed in claim 1, wherein the secondary winding is biased at a high voltage and the primary winding is placed in line with the secondary winding.

7. The filament transformer as claimed in claim 1, wherein the first partition is configured to increase creepage distance and insulation between the primary and the secondary winding.

8. The filament transformer as claimed in claim 1, wherein the second partition is configured to increase the creepage distance and insulation between the secondary winding and the core.

9. A method of shielding in an in-line filament transformer having a primary winding and a secondary winding wound in a line around a bobbin comprising: providing a shield in a primary section of the bobbin for shielding direct and fringe fields between the primary winding and the secondary winding, further comprising winding the shield in a defined manner and incorporating the shield winding on the primary section of the bobbin, wherein winding of the shield winding in a defined manner comprises:

(a) defining a gap in the primary section of the bobbin, the gap is defined in the primary section of the bobbin adjacent to the secondary section of the bobbin;

(b) winding a layer of the shield across the primary section of bobbin along the bobbin axis, up to the gap;

(c) winding the primary winding inside the primary section of the bobbin along the bobbin axis up to the gap;

(d) winding additional layers of shield in the gap; and (e) winding a layer of a shield over the primary winding.

10. The method of shielding as in claim 9 comprising, providing the primary winding in the primary section and the secondary winding in the secondary section of the bobbin.

11. The method of shielding as in claim 9 comprising, winding the primary winding and secondary winding along a bobbin axis, the direction of the axis being directed towards the secondary winding.

12. The method of shielding as in claim 9, wherein the step of winding the primary winding inside the primary section of the bobbin comprises: winding a first layer of the primary winding in the direction of the bobbin axis; returning in the direction opposite to the direction of the bobbin axis for winding the next layer of primary winding; and winding the next layer of winding.

13. The method of shielding as in claim 9, wherein the height of the gap is based on the height of the primary winding.

14. The method of shielding as in claim 9, comprising providing a partition between the primary section of the bobbin and secondary section of the bobbin for placing a shield.

15. The method of shielding as in claim 14, comprising placing the shield on a partition provided in the secondary section of the bobbin adjacent to the primary section for increasing creepage.

16. A filament transformer for an X-ray tube comprising:

(a) a core;

(b) a primary winding and a secondary winding wound around a bobbin placed on the core, wherein the bobbin is configured to include a primary section for incorporating the primary winding and a secondary section for incorporating the secondary winding;

(c) a plurality of partitions provided on the bobbin, wherein a first partition is provided on the secondary section adjacent to the primary section of the bobbin and a second partition is provided on the secondary section of the bobbin adjacent to the core; and (d) a shield provided in the primary section of the bobbin; wherein the shield in the form of a shield winding, a first layer of the winding being provided in the direction of a bobbin axis adjacent to the core, in the primary section of bobbin, a second layer of the shield winding being provided on a gap defined in the primary section of the bobbin adjacent to the secondary section of bobbin and a third layer of shield winding being provided over the primary winding.

* * * * *